US008777454B2

(12) United States Patent
Yen

(10) Patent No.: US 8,777,454 B2
(45) Date of Patent: Jul. 15, 2014

(54) LAMP COLOR TEMPERATURE CHANGE STRUCTURE

(71) Applicant: Excellent Idea Corp., The Valley (AI)

(72) Inventor: Chung-Chun Yen, Taichung (TW)

(73) Assignee: Excellent Idea Corp., The Valley (AI)

( * ) Notice: Subject to any disclaimer, the term of this patent is extended or adjusted under 35 U.S.C. 154(b) by 37 days.

(21) Appl. No.: 13/648,413

(22) Filed: Oct. 10, 2012

(65) Prior Publication Data

US 2013/0335974 A1 Dec. 19, 2013

(30) Foreign Application Priority Data

Nov. 11, 2011 (TW) ..... 100221358 U

(51) Int. Cl.
*F21V 17/02* (2006.01)

(52) U.S. Cl.
CPC ..... *F21V 17/02* (2013.01)
USPC ..... 362/280; 362/293

(58) Field of Classification Search
USPC ..... 362/270, 271, 272, 280, 293
See application file for complete search history.

(56) References Cited

U.S. PATENT DOCUMENTS

| | | | | |
|---|---|---|---|---|
| 5,258,895 | A * | 11/1993 | Bosse | 362/281 |
| 6,953,269 | B2 * | 10/2005 | Dedoro | 362/293 |
| 8,197,094 | B2 * | 6/2012 | Quadri et al. | 362/279 |
| 2006/0209555 | A1 * | 9/2006 | Kuo et al. | 362/513 |
| 2007/0211468 | A1 * | 9/2007 | Allegri | 362/268 |
| 2009/0073696 | A1 * | 3/2009 | Melzner | 362/279 |
| 2010/0061107 | A1 * | 3/2010 | Jurik | 362/319 |
| 2010/0141903 | A1 * | 6/2010 | Von Preyss | 353/84 |
| 2010/0195325 | A1 * | 8/2010 | Cheng et al. | 362/235 |
| 2012/0063144 | A1 * | 3/2012 | Bornhorst | 362/293 |
| 2012/0155090 | A1 * | 6/2012 | Quadri et al. | 362/293 |
| 2012/0162993 | A1 * | 6/2012 | Cheng et al. | 362/284 |

* cited by examiner

*Primary Examiner* — Laura Tso
(74) *Attorney, Agent, or Firm* — Ming Chow; Sinorica, LLC

(57) ABSTRACT

A lamp color temperature change structure includes a lamp holder, a light source on the lamp holder, a lift unit in front of the light source, and a colored lens mounted to the lift unit. The colored lens is movable and driven by the lift unit to a first position which is away from the front of the light source or a second position which is in front of the light source. The user can select the light from the light source to radiate toward the front of the lamp holder or penetrate the colored lens to generate a color temperature change and then radiate toward the front of the lamp holder according to different environment conditions.

8 Claims, 6 Drawing Sheets

LAMP COLOR TEMPERATURE CHANGE STRUCTURE

BACKGROUND OF THE INVENTION

1. Field of the Invention

The present invention relates to a lamp color temperature change structure.

2. Description of the Prior Art

A conventional lamp comprises a lamp holder. The front side of the lamp holder has a concave reflection trough to form an opening. The lamp holder comprises a bulb therein. Thus, the light from the bulb is reflected by the reflection trough to center and radiate toward the front of the lamp through the opening.

However, the light with different color temperate has a different illumination property. A vehicular lamp is as an example. When the color temperature is at a range of 2300K to 3800K, the light is yellowish and has a better penetration to provide a better illumination effect for a rain or foggy day.

When the color temperature is over 4200K, the light becomes white. When the color temperature is over 6000K, the light becomes blue. The light is more brilliant but the penetration is lowered so it is not adapted for a rain or foggy day. Accordingly, the inventor of the present invention has devoted himself based on his many years of practical experiences to solve these problems.

SUMMARY OF THE INVENTION

The primary object of the present invention is to provide a lamp color temperature change structure to adjust a desired color temperature according to different environment conditions.

In order to achieve the aforesaid object, the lamp color temperature change structure of the present invention comprises a lamp holder, a light source, a lift unit and a colored lens. The lamp holder has a front side and a rear side opposite to the front side. The front side of the lamp holder has a concave reflection trough to form an opening. The light source is disposed in the reflection trough. The lift unit is disposed on the lamp holder in front of the light source. The lift unit comprises at least one driving member. The driving member is connected with at least one lift rod. The colored lens is mounted to the lift rod. The colored lens is movable and driven by the lift rod to a first position or a second position relative to the light source. When the colored lens is moved to the first position, the colored lens is away from the front of the light source. When the colored lens is moved to the second position, the colored lens is in front of the light source.

When the colored lens is moved to the first position, the colored lens will be away from the front of the light source and the light source will direct radiate toward the front of the lamp holder. When the colored lens is moved to the second position, the colored lens will be in front of the light source. The light from the light source first penetrates the colored lens to generate a color temperature change and then radiates toward the front of the lamp holder. Thus, the lamp color temperature change structure will have a color temperature change function for a desired color temperature according to different environment conditions.

DETAILED DESCRIPTION OF THE PREFERRED EMBODIMENTS

Embodiments of the present invention will now be described, by way of example only, with reference to the accompanying drawings.

Figure 1:
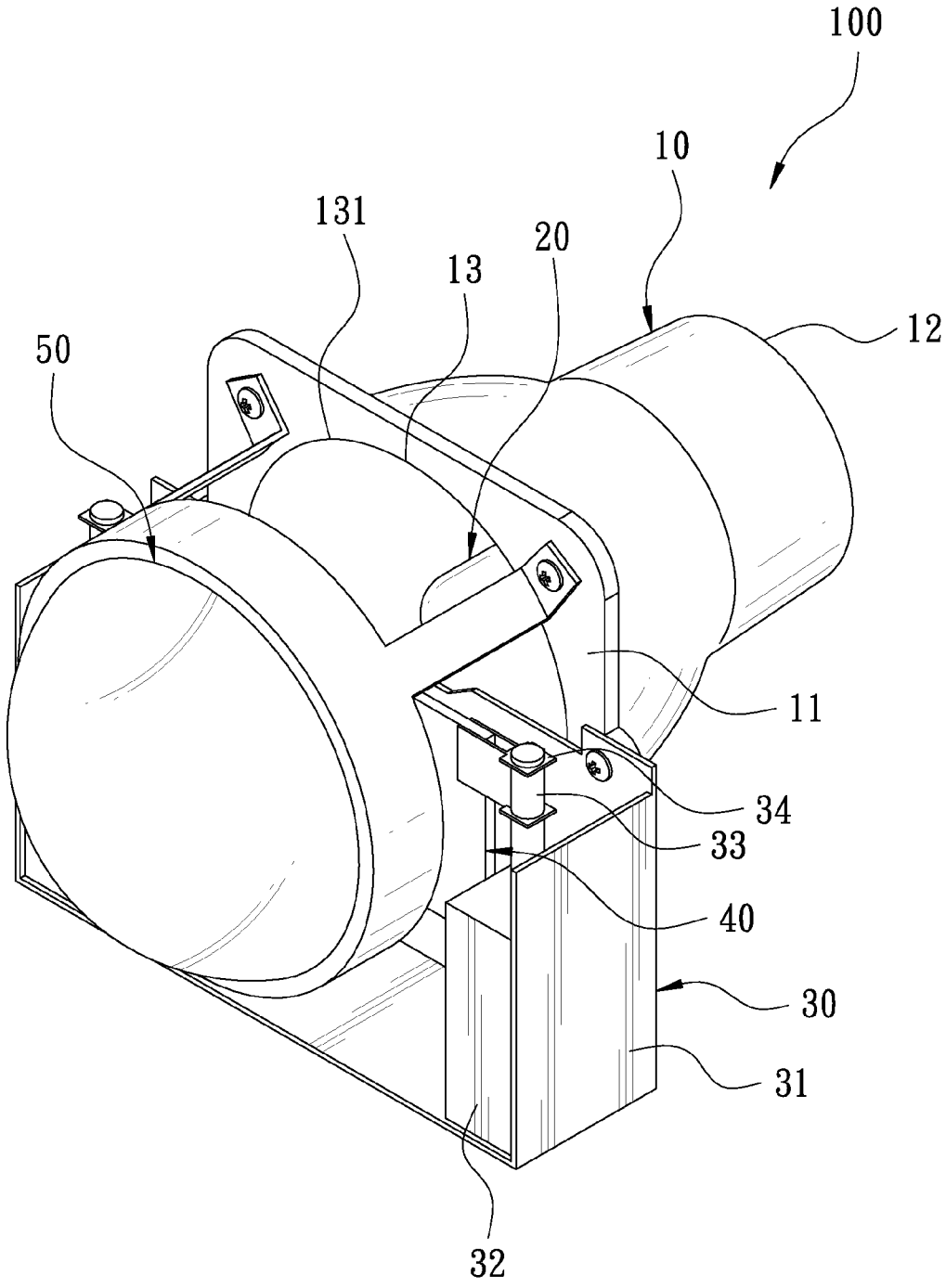
FIG. 1 is a perspective view according to a preferred embodiment of the present invention.
Figure 2:
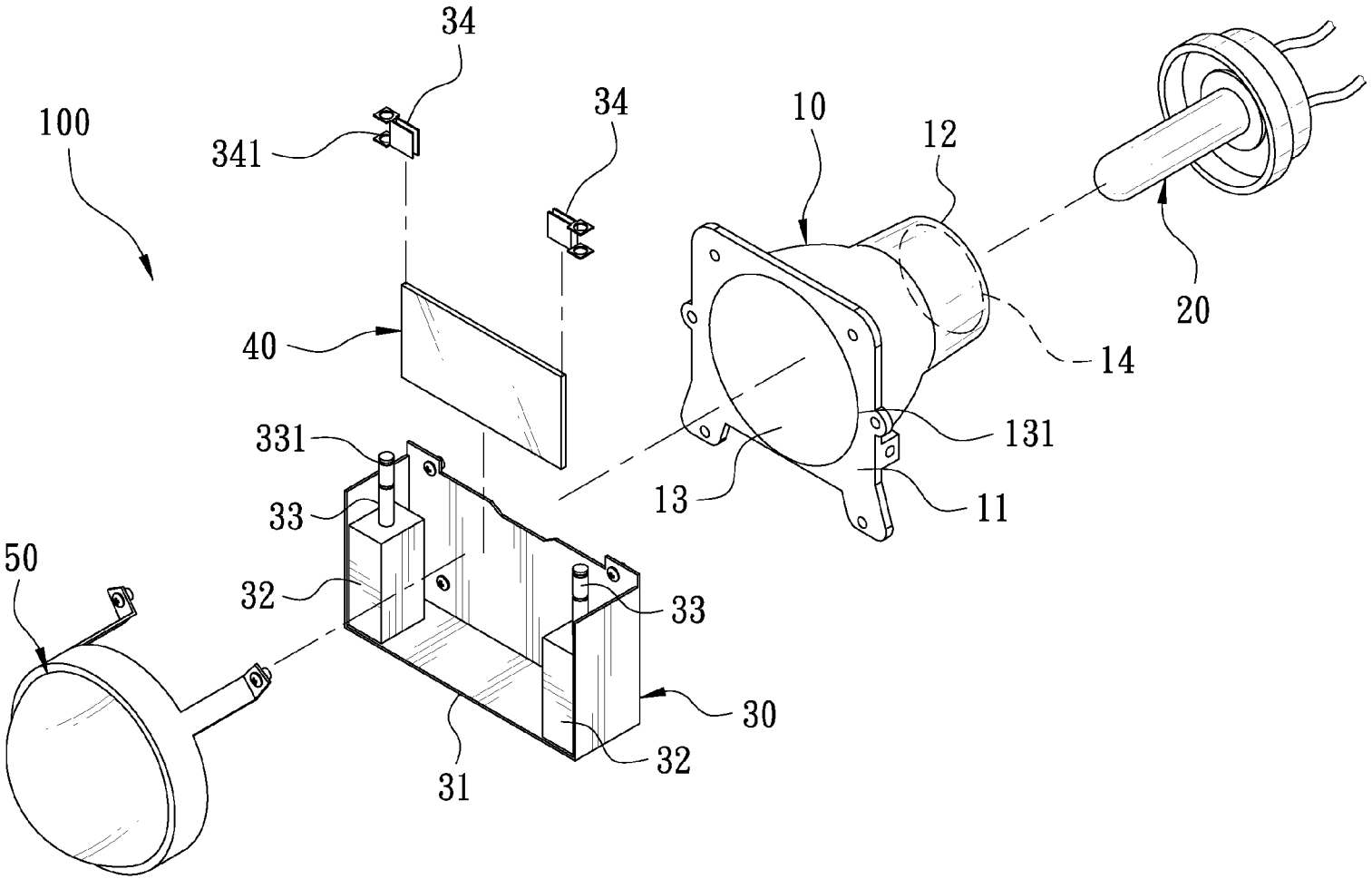
FIG. 2 is an exploded view according to the preferred embodiment of the present invention.
Figure 3:
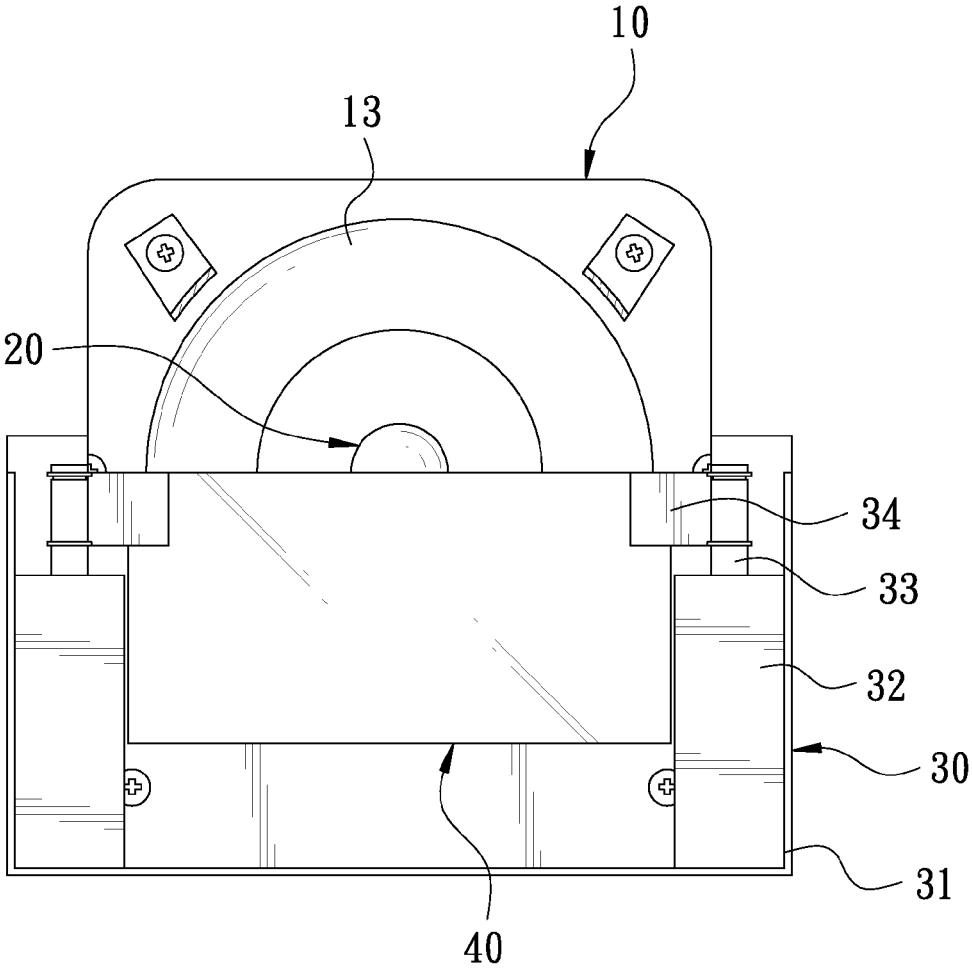
FIG. 3 is a transverse sectional view according to the preferred embodiment of the present invention.

FIG. 1 is a perspective view according to a preferred embodiment of the present invention. FIG. 2 is an exploded view according to the preferred embodiment of the present invention. FIG. 3 is a transverse sectional view according to the preferred embodiment of the present invention. The present invention discloses a lamp color temperature change structure 100 which can be applied to various lamps. In this embodiment, the lamp color temperature change structure 100 is applied to a vehicular fish-eye lamp. The lamp color temperature change structure 100 comprises a lamp holder 10, a light source 20, a lift unit 30 and a colored lens 40.

The lamp holder 10 has a front side 11 and a rear side 12 opposite to the front side 11. The front side 11 of the lamp holder 10 has a concave reflection trough 13 to form an opening 131. The rear side 12 of the lamp holder 10 has a fixing hole 14 which communicates with the reflection trough 13.

The light source 20 is disposed in the reflection trough 13. In this embodiment, the light source 20 is an HID (High intensity discharge) bulb and coupled to the fixing hole 14 of the lamp holder 10.

The lift unit 30 is disposed on the lamp holder 10 and in front of the light source 30. The lift unit 30 comprises a fixing frame 31 connected to the front side 11. The fixing frame 31 is provided with at least one driving member 32. The driving member 32 is connected with at least one lift rod 33. The driving member 32 is one of a solenoid valve, a press cylinder and a motor. When the driving member 32 is a motor, the lift rod 33 is a spiral rod. In this embodiment, the lift unit 30 comprises two driving members 32. The driving members 32 are solenoid valves which are located at two opposing sides of the opening 131. Each driving member 32 is connected with one lift rod 33. The distal end of the lift rod 33 is provided with a gripper 34. The distal end of the lift rod 33 has two engaging grooves 331 and the gripper 34 has corresponding engaging rings 341 to be secured to the engaging grooves 331, so that the gripper 34 is secured to the distal end of the lift rod 33.

Figure 4:
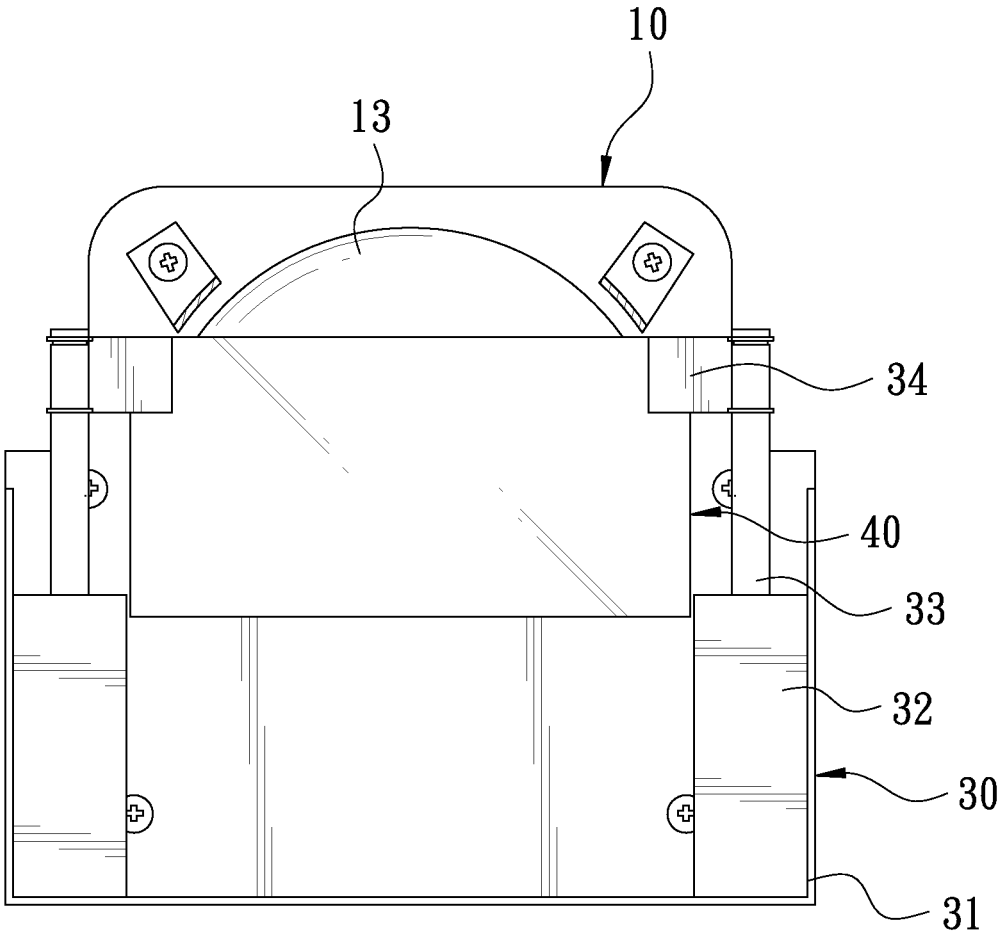
FIG. 4 is a transverse sectional view showing operation of the preferred embodiment of the present invention.

The colored lens 40 is mounted to the lift rod 33. As shown in FIG. 3, the colored lens 40 is movable and driven by the lift rod 33 to a first position or to a second position, as shown in FIG. 4, relative to the light source 20. When the colored lens 40 is moved to the first position, the colored lens 40 is away from the front of the light source 20. When the colored lens 40 is moved to the second position, the colored lens 40 is in front of the light source 20. In this embodiment, two opposing sides of the colored lens 40 are connected to the grippers 34, so the colored lens 40 is located between the two lift rods 33.

A convex lens 50 is fixed to the front side 11 of the lamp holder 10 and located in front of the lift unit 30.

Figure 5:
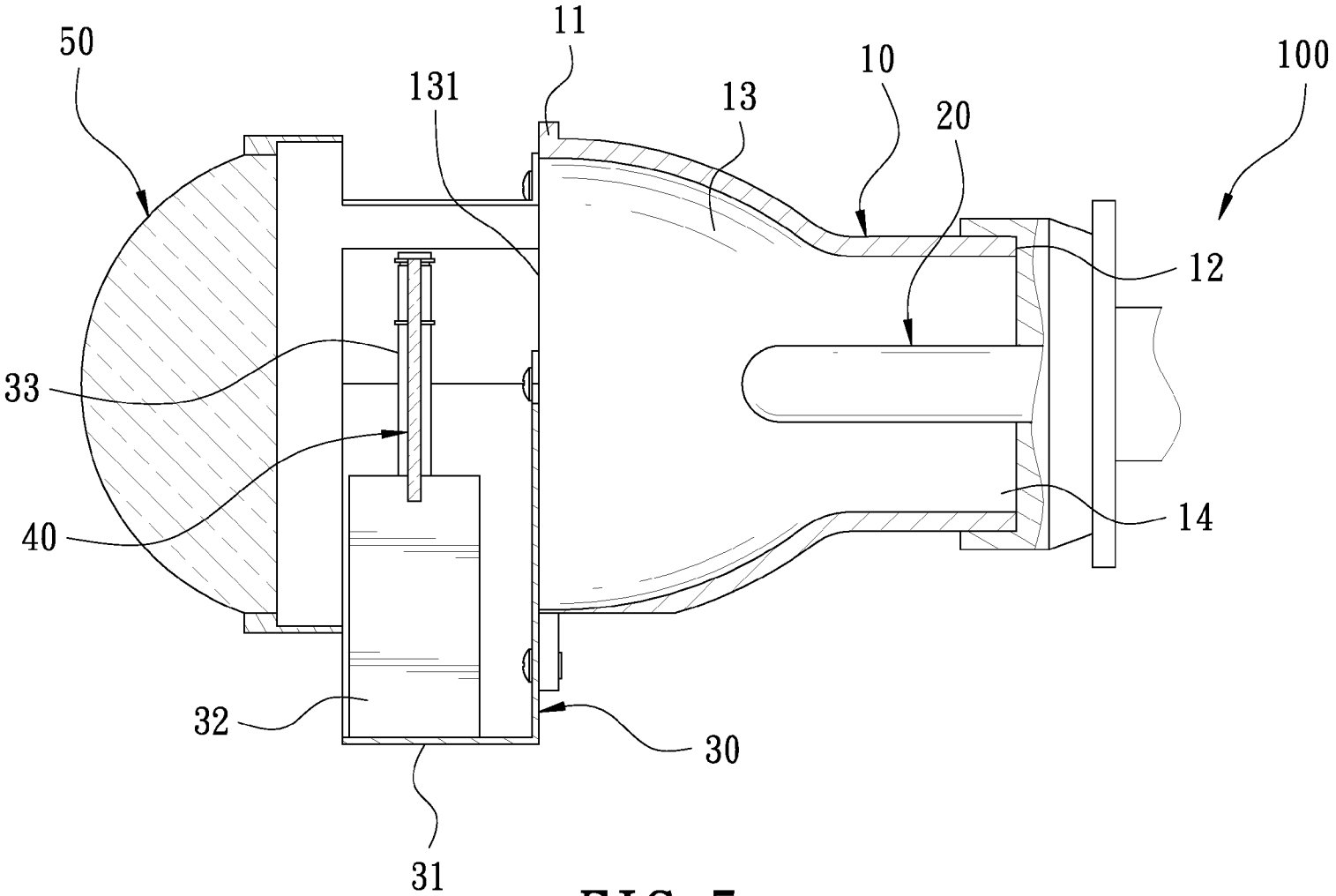
FIG. 5 is a vertical sectional view showing operation of the preferred embodiment of the present invention.

FIG. 4 and FIG. 5 are schematic views showing operation of the preferred embodiment of the present invention. In a normal state, the colored lens 40 is located at the first position, as shown in FIG. 3, away from the light source 20. When the light source 20 is turned on, the light source 20 direct radiates toward the front of the lamp holder 10 to provide illumination for a vehicle. When the user wants to change the color temperature, he/she just controls the lift unit 30. The driving members 32 of the lift units 30 will drive the lift rods 33 to bring the colored lens 40 to the second position, as shown in FIG. 4. The colored lens 40 is located in front of the light source 20, so the light from the light source 20 first penetrates the colored lens 40 to generate a color temperature change, and then radiates toward the front of the lamp holder 10. Thus, the lamp color temperature change structure 100 will have a color temperature change function for a desired color temperature according to different environment conditions. For example, in this embodiment, the light source 20 uses an HID bulb of 6500K and the colored lens 40 is a yellow lens, so that the lamp color temperature change structure 100 provides a better illumination effect. When there is rain or mist, the colored lens 40 can be adjusted to the second position. The light penetrates the colored lens 40 to be filtered to become yellow light, increasing the penetration of the light to enhance the safety of driving.

Figure 6:
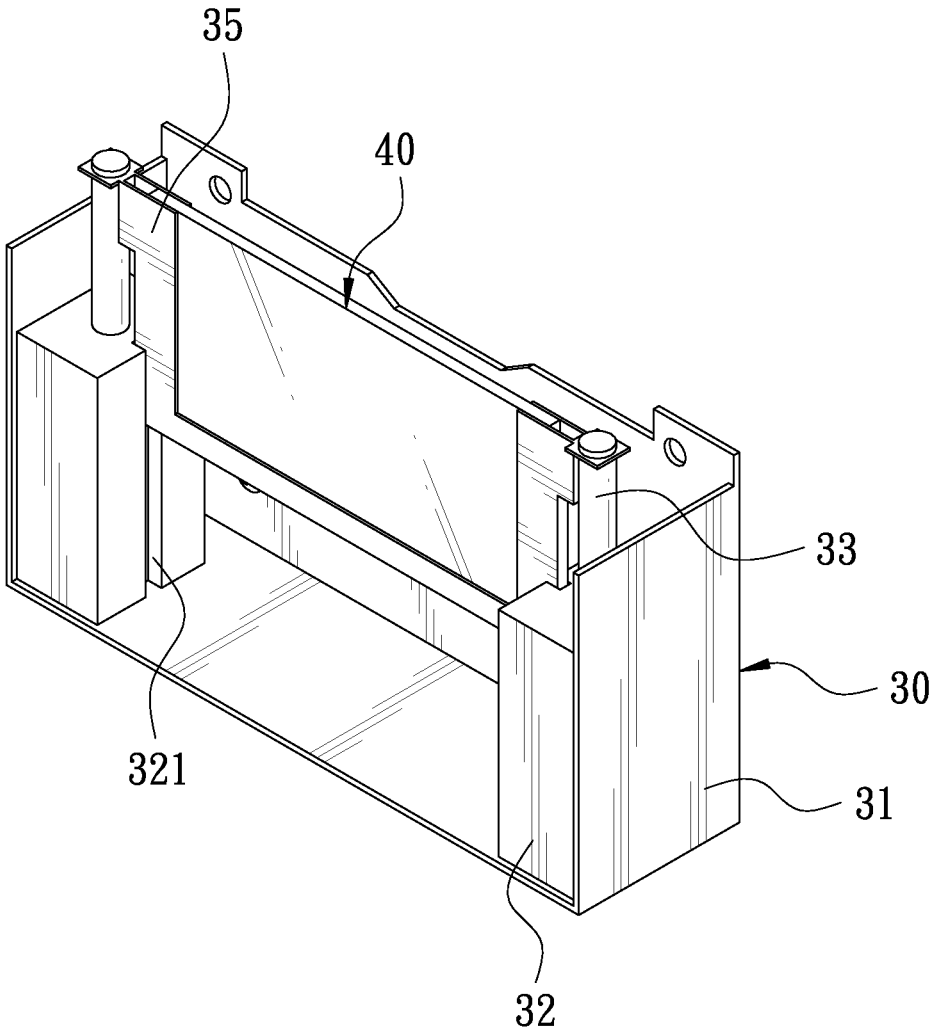
FIG. 6 is a perspective view according to another embodiment of the present invention.

FIG. 6 is a perspective view according to another embodiment of the present invention, which is substantially similar to the aforesaid embodiment with the exceptions described hereinafter. The driving members 32 have slide grooves 321 at respective sides thereof. A frame 35 is connected between the lift rods 33. The colored lens 40 is disposed in the frame 35. The two opposing sides of the colored lens 40 slide in the slide grooves 321, having the same effect as the aforesaid embodiment. The colored lens 40 can be steady adjusted by the lift unit 30 and won't shake easily.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lamp color temperature change structure, comprising:

a lamp holder having a front side and a rear side opposite to the front side, the front side of the lamp holder having a concave reflection trough to form an opening;

a light source disposed in the reflection trough;

a lift unit disposed on the lamp holder in front of the light source, the lift unit comprising at least one driving member, the driving member being connected with at least one lift rod; and a colored lens mounted to the lift rod, the colored lens being movable and driven by the lift rod to a first position or a second position relative to the light source, wherein, when the colored lens is moved to the first position, the colored lens is away from the front of the light source, when the colored lens is moved to the second position, the colored lens is in front of the light source;

the lift unit is disposed at the front side of the lamp holder and comprises two driving members, the two driving members being located at two opposing sides of the opening, each driving member being connected with the lift rod, the colored lens being connected between the lift rods of the two driving members;

a distal end of the lift rod of each driving member is provided with a gripper, the grippers of the lift rods of the two driving members being adapted to grip two opposing sides of the colored lens.

2. The lamp color temperature change structure as claimed in claim 1, wherein the two driving members have slide grooves at respective sides thereof and two opposing sides of the colored lens slide in the slide grooves.

3. The lamp color temperature change structure as claimed in claim 1, wherein the lift unit further comprises a frame connected between the lift rods of the two driving members and the colored lens is disposed in the frame.

4. The lamp color temperature change structure as claimed in claim 1, wherein the lift unit further comprises a fixing frame connected to the front side of the lamp holder and the driving member is mounted to the fixing frame.

5. The lamp color temperature change structure as claimed in claim 1, wherein the lift unit further comprises a fixing frame connected to the front side of the lamp holder and the two driving members are mounted to the fixing frame.

6. The lamp color temperature change structure as claimed in claim 1, wherein the driving member is a solenoid valve.

7. The lamp color temperature change structure as claimed in claim 1, wherein the driving member is a motor and the lift rod is spiral rod.

8. The lamp color temperature change structure as claimed in claim 1, wherein the driving member is a press cylinder.

* * * * *